US005829425A

United States Patent [19]

Woods et al.

[11] Patent Number: 5,829,425

[45] Date of Patent: Nov. 3, 1998

[54] INTEGRAL BURNER CONTROL AND MANIFOLD

[75] Inventors: Garry Wayne Woods, Heiskell; William L. Hillis, Lawrenceburg; William J. Ferlin, Franklin; Anthony W. Simpson, Jacksboro, all of Tenn.

[73] Assignee: Lincoln Brass Works, Inc., Jacksboro, Tenn.

[21] Appl. No.: 602,397

[22] Filed: Feb. 16, 1996

[51] Int. Cl.[6] ..... F24C 3/00

[52] U.S. Cl. ..... 126/39 E; 126/39 R; 251/208; 137/883; 431/278

[58] Field of Search ..... 431/354, 355, 431/278; 126/39 E, 39 R; 239/562; 137/883; 251/208

[56] References Cited

U.S. PATENT DOCUMENTS

| | | | |
|---|---|---|---|
| 148,909 | 3/1874 | Wigham | 239/562 |
| 1,074,789 | 10/1913 | Green . | |
| 1,214,819 | 2/1917 | Parks . | |
| 1,445,984 | 2/1923 | Wilkinson . | |
| 1,642,154 | 9/1927 | Kemp . | |
| 1,656,447 | 1/1928 | Schenk . | |
| 1,751,591 | 3/1930 | McCloskey . | |
| 1,786,330 | 12/1930 | Berkeley . | |
| 1,788,753 | 1/1931 | Tinnerman . | |
| 1,878,552 | 3/1932 | Tinnerman . | |
| 2,033,369 | 3/1936 | Baker . | |
| 2,048,065 | 7/1936 | Gauger . | |
| 2,087,720 | 7/1937 | Guenther et al. . | |
| 2,088,505 | 7/1937 | Brumbaugh . | |
| 2,109,399 | 2/1938 | Meacham et al. . | |
| 2,439,539 | 4/1948 | Cellwork . | |
| 2,521,092 | 9/1950 | Pratt . | |
| 2,657,092 | 10/1953 | Jones . | |
| 2,896,975 | 7/1959 | Wahl et al. . | |
| 3,312,396 | 4/1967 | Willson . | |
| 3,744,754 | 7/1973 | Demi . | |
| 3,746,039 | 7/1973 | Demi . | |
| 3,766,905 | 10/1973 | Sekera, Jr. . | |
| 3,814,125 | 6/1974 | Demi . | |
| 3,820,563 | 6/1974 | Demi . | |
| 4,005,697 | 2/1977 | Perl . | |
| 4,020,821 | 5/1977 | Reid, Jr. et al. . | |
| 4,402,300 | 9/1983 | Houck . | |
| 4,409,954 | 10/1983 | Berlik et al. . | |
| 4,413,611 | 11/1983 | Berlik et al. . | |
| 4,572,154 | 2/1986 | Schweitzer . | |
| 4,622,946 | 11/1986 | Hurley et al. . | |
| 4,627,411 | 12/1986 | Mertler . | |
| 4,638,950 | 1/1987 | Collinson et al. | 239/551 |
| 4,705,018 | 11/1987 | Beach . | |
| 4,750,470 | 6/1988 | Beach et al. . | |
| 4,754,744 | 7/1988 | Borg . | |
| 4,870,993 | 10/1989 | Casuso . | |
| 5,094,612 | 3/1992 | Vallat | 239/551 |
| 5,099,822 | 3/1992 | Cramer et al. . | |
| 5,119,802 | 6/1992 | Cherry et al. . | |
| 5,301,653 | 4/1994 | Gerdes et al. . | |

FOREIGN PATENT DOCUMENTS

| | | |
|---|---|---|
| 0623787A1 | 9/1994 | European Pat. Off. . |
| 1356255 | 6/1974 | United Kingdom . |

*Primary Examiner*—Carl D. Price
*Attorney, Agent, or Firm*—Harness, Dickey & Pierce, P.L.C.

[57] ABSTRACT

A gas range includes a gas distribution system which incorporates a multi-chambered gas manifold. The gas manifold includes a single gas inlet chamber and a plurality of gas outlet chambers. Communication between the gas inlet chamber and each gas outlet chamber is controlled by a respective rotating disc element which controls the flow of gas between the two chambers. The length of the gas manifold can be dictated by the spacing of the individual disc elements or it can be dictated by the spacing of the burners. The gas distribution system provides additional flexibility to the range designer while reducing costs by eliminating components.

20 Claims, 4 Drawing Sheets

INTEGRAL BURNER CONTROL AND MANIFOLD

FIELD OF THE INVENTION

The present invention relates generally to a gas distribution system for a range, a gas barbecue or any other gas appliance with burners. More specifically, the present invention relates to a gas distribution system for a range, a gas barbecue or any other gas appliance with burners which includes a manifold assembly for delivering gas to the individual burners with each burner being controlled by a valve which is manufactured as an integral part of the manifold assembly.

BACKGROUND AND SUMMARY OF THE INVENTION

Prior art gas ranges, gas barbecues and other gas appliances with burners have generally been designed with gas valves being mounted directly to the outside of a gas manifold. The generally accepted industry practice has been to fabricate a gas manifold from gas pipe or other conduit material and then mount the gas valves directly to the outside of the gas pipe. The gas manifold extends linearally along the front or side of the range with the gas valve stems generally in line with the gas manifold. The valve stems extend from the manifold through the top or front of the range and are provided with some type of a knob for the convenience of the operator.

When the design of the gas appliance requires the control valves to be closely spaced or located in a clustered arrangement, the individual valves can be placed in communication with a gas manifold using individual gas lines extending between the gas manifold and the gas valve or the gas manifold can be designed such that it accommodates the closely spaced or clustered arrangement of the gas valves.

Continued developments of gas appliances include the development of gas distribution systems which reduce the cost of manufacture while at the same time providing added flexibility to the designers of the appliances to position the valves at various locations on the individual gas appliances.

The present invention provides the art with a gas distribution system which includes a gas manifold having one common gas supply chamber which accommodates a plurality of rotating disc elements for controlling the flow of fluid to the individual burners. The rotating disc elements are positioned inside the gas supply chamber providing a manifold assembly having an integral burner control with the manifold. This manifold assembly reduces the manufacturing costs and simplifies the construction of the prior art gas distribution systems by eliminating the prior art valve bodies. One embodiment of the present invention includes a plurality of distinctive segregated gas outlet chambers. Each of the rotating disc elements controls the gas flow between the common gas supply chamber and a corresponding gas outlet chamber. The individual gas outlet chambers permit the rotating disc element to be positioned at one location along the length of the manifold while allowing the connection leading to the burner to be located at a different location along the length of the manifold for providing added versatility for the location of these elements on the appliance. A second embodiment of the present invention includes a single chambered manifold within which each of the rotating disc elements are mounted. The rotating disc elements control the gas flow between the single chambered manifold and gas lines leading to a specific burner. Both embodiments offer the advantage of supporting the end of the stem within the manifold as well as supporting the stem by the front cover. This dual but separate and distinct support of the stem reduces wobble or stem displacement which improves the feel and overall quality of the gas appliance.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
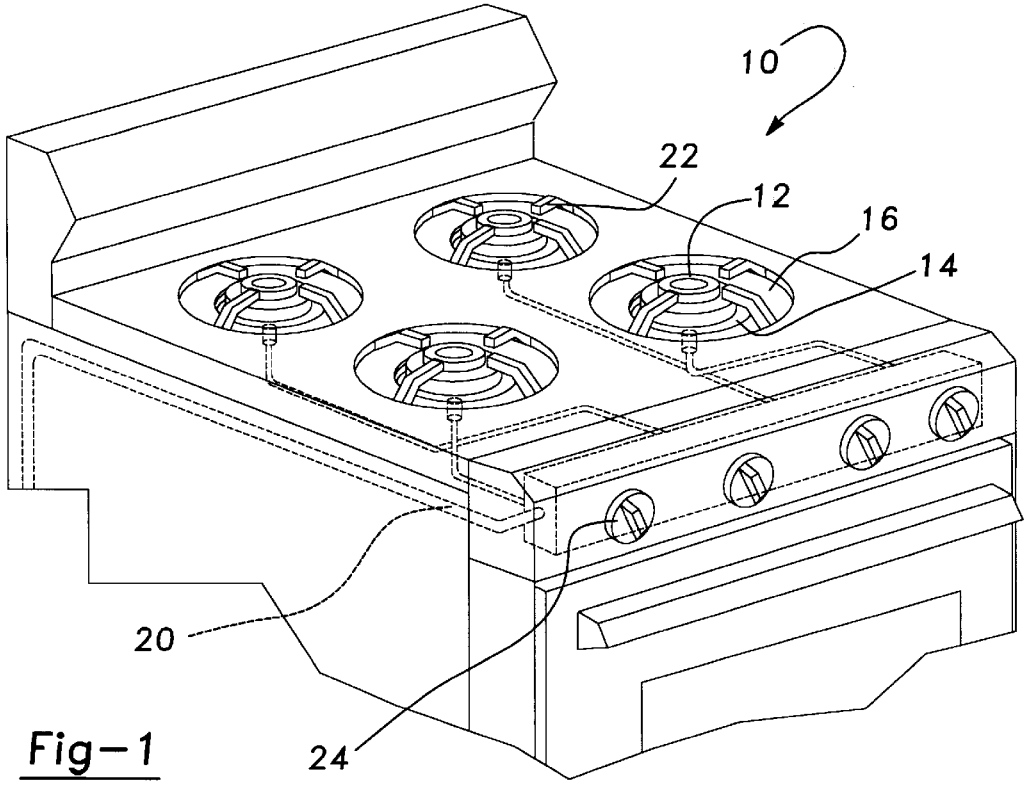
FIG. 1 is a front perspective view of an appliance illustrating the gas distribution system in accordance with the present invention.

Referring now to the drawings in which like reference numerals designate like or corresponding parts throughout the several views, there is shown in FIG. 1 an appliance which is designated generally by the reference numeral 10. Appliance 10 can be a portion of a free standing range and oven combination, appliance 10 can be a range top supported by a counter surface or any other design of cooking appliance including a gas barbecue grill. Appliance 10 includes a plurality of sealed gas burners 12, each disposed in a depression 14 formed in a cooking surface 16 to contain spills and the like. Each sealed burner 12 sits in an opening in cooking surface 16 to provide access to the heating unit by a gas distribution system 20. A removable grate 22 is provided to support cooking utensils over sealed burners 12. A control knob 24 for each sealed burner 12 enables a user to turn the units on and off and adjust the heat setting by regulating the gas flow to each sealed burner 12 within distribution system 20.

In the preferred embodiment, appliance 10 is described as having sealed gas burners 12. The term "sealed burner" refers to the lack of an annular opening in cooking surface 16 around the base of sealed burners 12. Elimination of this opening prevents spills from entering the area beneath cooking surface 16 making cleanup easier. It is to be understood that the use of the individual sealed burners 12 herein described is for illustrative purposes and the design, quantity and size of the sealed burners 12 incorporated into appliance 10 is not intended nor is it to be construed as a limitation in the present invention.

Figure 2:
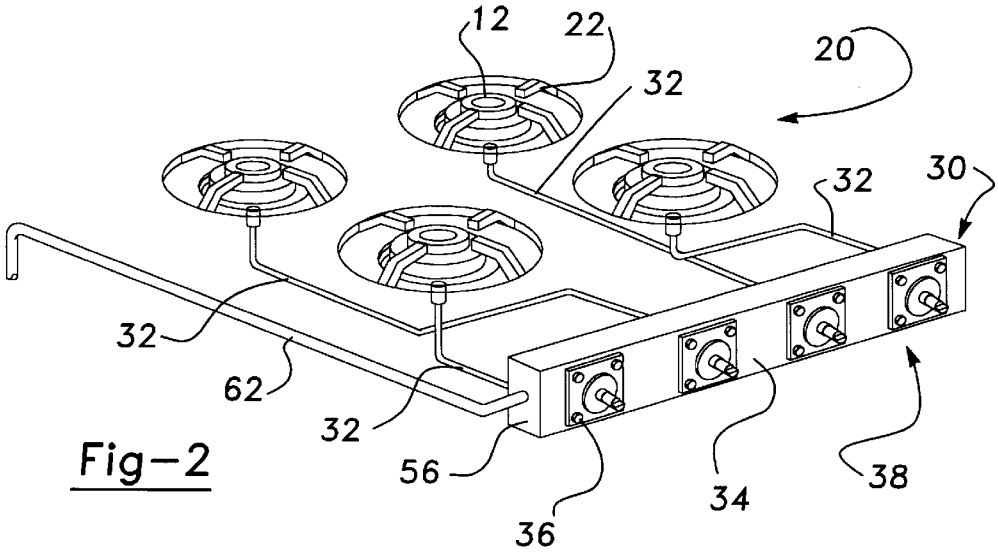
FIG. 2 is a front perspective view showing the gas distribution system in accordance with the present invention.
Figure 3:
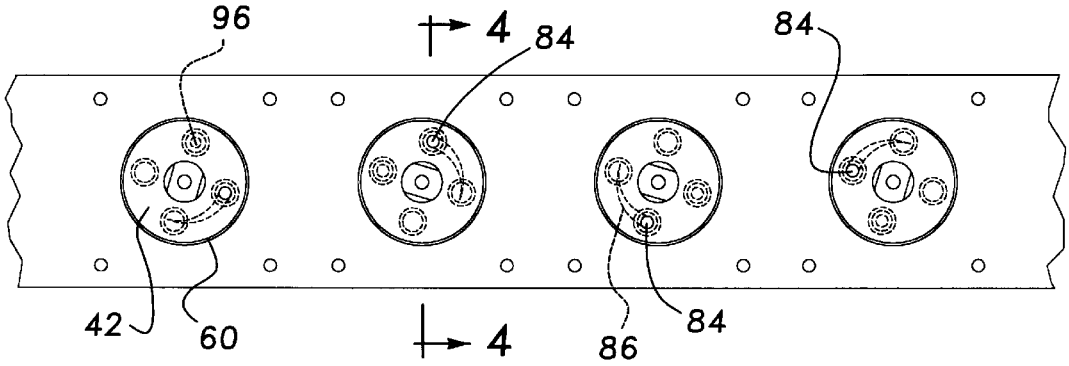
FIG. 3 is a front elevational view of the manifold assembly illustrating the rotating disc elements.
Figure 4:
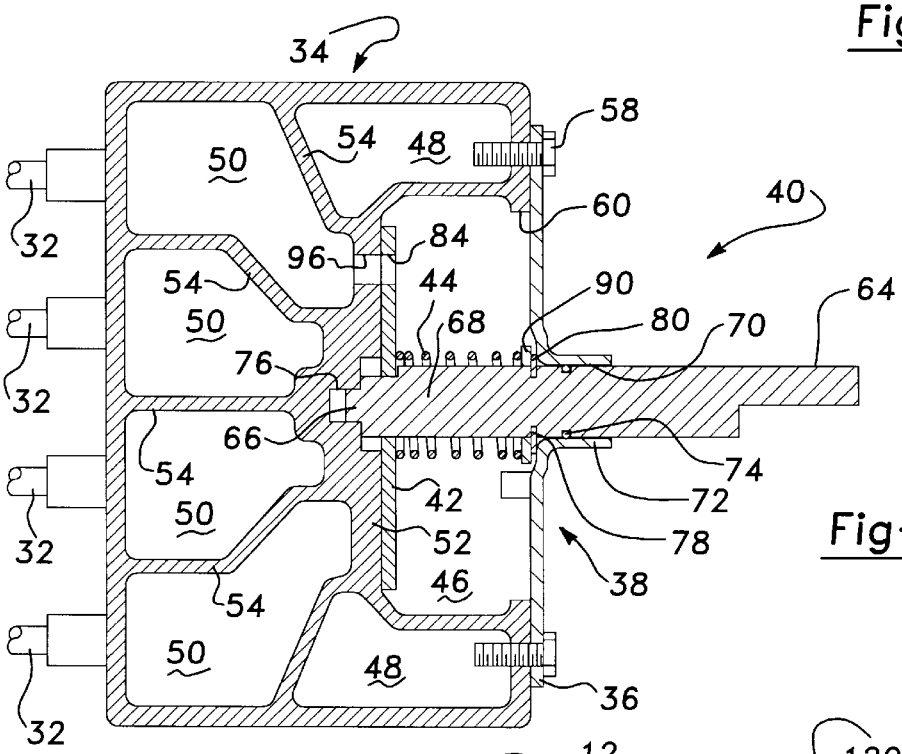
FIG. 4 is a cross sectional view taken in the direction of arrows 4—4 shown in FIG. 3.

Referring now to FIGS. 2–4, gas distribution system 20 comprises a multi-chambered manifold assembly 30, a plurality of gas lines or venturi tubes 32 and the plurality of sealed gas burners 12. Manifold assembly 30, shown in section in FIG. 4, comprises a manifold 34, a plurality of valve caps 36, and a plurality of valve assemblies 38 each of which include a valve stem 40, a valve disc 42 and a valve spring 44.

Manifold 34 is preferably manufactured from extruded aluminum to define a feed chamber 46, a pair of sealed voids 48 and a plurality of burner chambers 50. Chamber 46, sealed voids 48 and burner chambers 50 extend the entire length of manifold 34. A central web 52 extends the length of manifold 34 between feed chamber 46 and the plurality of burner chambers 50. Central web 52 is utilized to mount valve stems 40 and valve discs 42 as will be described later herein. A plurality of internal webs 54 extend the length of manifold 34 and are positioned between central web 52 and an exterior wall of manifold 34 to define and isolate sealed voids 48 and burner chambers 50. A pair of end caps 56 mate with the exterior walls of manifold 34, central web 52 and internal webs 54 to complete the isolation of sealed voids 48 and burner chambers 50.

Each valve cap 36 is sealingly secured to manifold 34 by a sealing gasket, such as RTV, and a plurality of screws 58 to cover an access hole 60 to close feed chamber 46 and provide a sealed input chamber which functions as a distribution manifold for gas distribution system 20. A gas supply line 62 is shown extending through one end cap 56 to provide fuel to chamber 46. It is to be understood that supply line 62 could extend through either end cap 56 or through one of the walls of manifold 34 if desired for packaging or design considerations.

Each valve stem 40 is rotatably supported by both manifold web 52 of manifold 34 and a respective valve cap 36. This dual but separate and distinct support of valve stem 40 reduces wobble or stem displacement to an average of approximately 0.010 inches which is an improvement over the prior art industry average of approximately 0.020 inches. This reduction of stem wobble or displacement improves the feel and overall quality of appliance 10. While only one valve stem 40 will be described herein, it is to be understood that the other valve stems 40 are assembled to manifold 34 and a respective valve cap 36 in a similar manner. Valve stem 40 includes a cylindrical shaft 64, a cylindrical stub shaft 66 and a generally rectangular section 68. Cylindrical shaft 64 is rotatably secured within an aperture 70 extending through valve cap 36. Valve cap 36 includes an integral annular shoulder 72 which provides an increased amount of bearing support for shaft 64 as well as providing a seat for valve spring 44. A seal 74 seals the interface between cylindrical shaft 64 of valve stem 40 and shoulder 72 of valve cap 36. Circular stub shaft 66 of valve stem 40 extends axially from the end of shaft 64 which is positioned towards central web 52 of manifold 34. Stub shaft 66 is rotatably supported within an aperture 76 located within central web 52. Generally rectangular section 68 is disposed between shaft 64 and stub shaft 66 to mate with valve disc 42 as will be described later herein. The outside surface of shaft 64 defines a groove 78 which accepts a retaining ring 80 to retain valve stem 40 within valve cap 36. Retaining ring 80 abuts annular shoulder 72 to retain valve stem 40. Valve disc 42 is slidingly received on generally rectangular section 68 of valve stem 40. The outside diameter of valve disc 42 is smaller than access hole 60 to allow for the insertion of valve disc 42 into chamber 46. The generally rectangular shape of section 68 allows for the rotation of valve disc 42 with valve stem 40 but allows valve disc 42 to move axially along section 68. Valve disc 42 defines a through bore 84 for routing the flow of fluid between feed chamber 46 and one of the burner chambers 50. Valve disc 42 also defines a converging circular slot 86 which functions to vary the amount of fluid being provided between feed chamber 46 and the burner chamber 50. Converging circular slot 86 is deepest when it meets bore 84 and is shallowest at the tip of its converging sides. The shape of slot 86 is configured to provide a straight line or a linear flow rate when the gas flow is charted on a graph from high to low. The size and dimensioning of slot 86 will define the rate of fluid flow in relation to the rotation of valve disc 42 and valve stem 40.

Valve spring 44 is disposed within chamber 46 and extends between a washer 90 retained by retaining ring 80 and valve disc 42 to bias valve disc 42 against central web 52 of manifold 34. The biasing of valve disc 42 against central web 52 creates a sealing relationship between valve disc 42 and central web 52.

Manifold assembly 30 supplies gas to the individual sealed gas burners 12 by locating a perspective gas line 32 between an individual burner 12 and one of the plurality of burner chambers 50 located within manifold 34. Gas line 32 enables fluid communication between a sealed gas burner 12 and one of the burner chambers 50. Each sealed gas burner 12 communicates with a separate burner chamber 50. Thus, manifold assembly 30 illustrated in FIGS. 1–4 of the present invention is capable of supporting from one to four separate sealed gas burners because there are four burner chambers 50 defined by manifold 34. It is to be understood that a smaller number of burners or a larger number of burners could be supported by subtracting from or adding to the number of burner chambers 50 defined by manifold 34. A gas flow aperture 96 is formed between each burner chamber 50 being utilized and chamber 46 to provide for the supply of gas from chamber 46 to the respective burner chamber 50 and thus the respective sealed gas burner 12. Gas flow aperture 96 is covered by valve disc 42 and when bore 84 or slot 86 is not aligned with gas flow aperture 96, there will be no gas flow to the respective burner 12. Rotation of valve stem 40 causes rotation of valve disc 42 to bring into line bore 84 or slot 86 with aperture 96 allowing the flow of gas to the respective burner 12. The configuration of bore 84 and slot 86 in conjunction with the configuration of gas flow aperture 96 will define the rate of gas flow in relation to the amount of rotation of valve stem 40. While FIG. 4 illustrates only the upper burner chamber 50 as having a gas flow aperture 96, it is to be understood that each burner chamber 50 includes a gas flow aperture 96 which mates with a respective valve disc 42 as illustrated in FIG. 3.

Thus, the design of gas distribution system 20 permits each valve stem 40 to be positioned anywhere along the length of manifold assembly 30 while also allowing the corresponding gas line 32 to be located anywhere along the length of manifold assembly 30 without the requirement that each valve stem 40 being in line with its respective gas line 32. This feature provides reduced costs due to the elimination of the valve body and the related assembly requirements while simultaneously permitting the independent locating of valve stems and gas lines to provide the maximum amount of flexibility to the designer without the requirement of complicated gas line routings.

Figure 5:
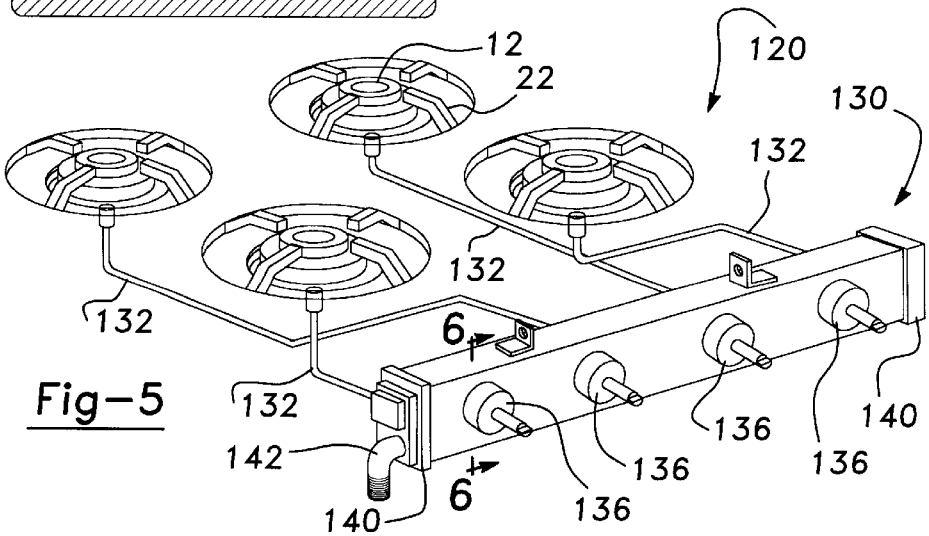
FIG. 5 is a front perspective view showing a gas distribution system in accordance with another embodiment of the present invention.
Figure 6:
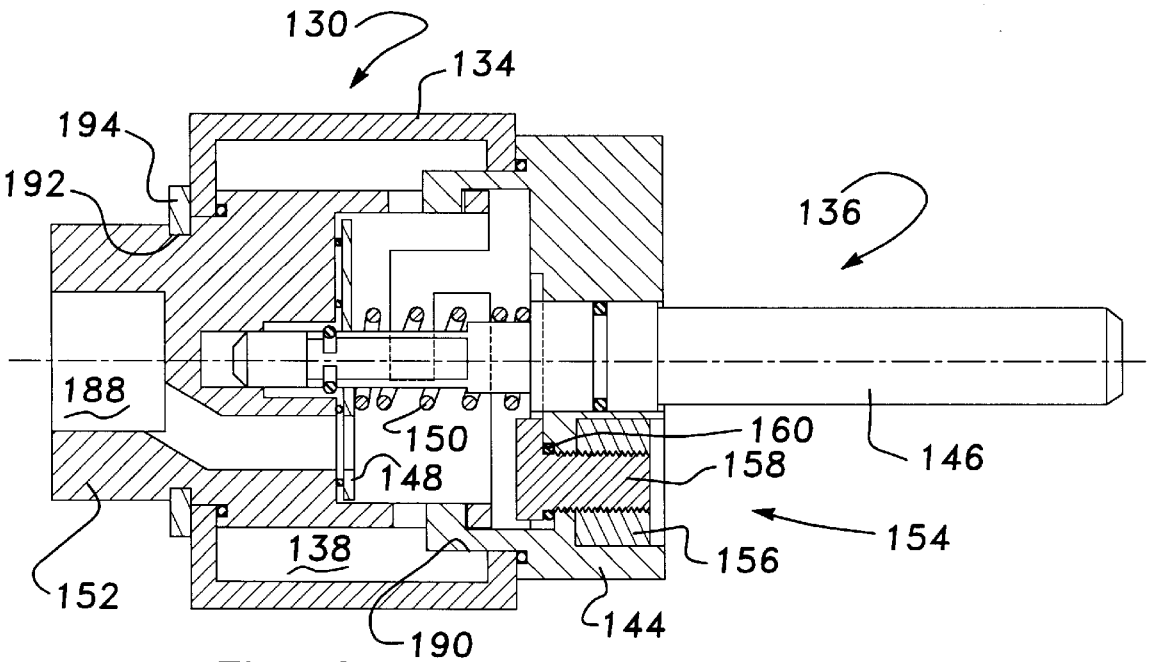
FIG. 6 is a cross sectional view taken in the direction of arrows 6—6 shown in FIG. 5.
Figure 7:
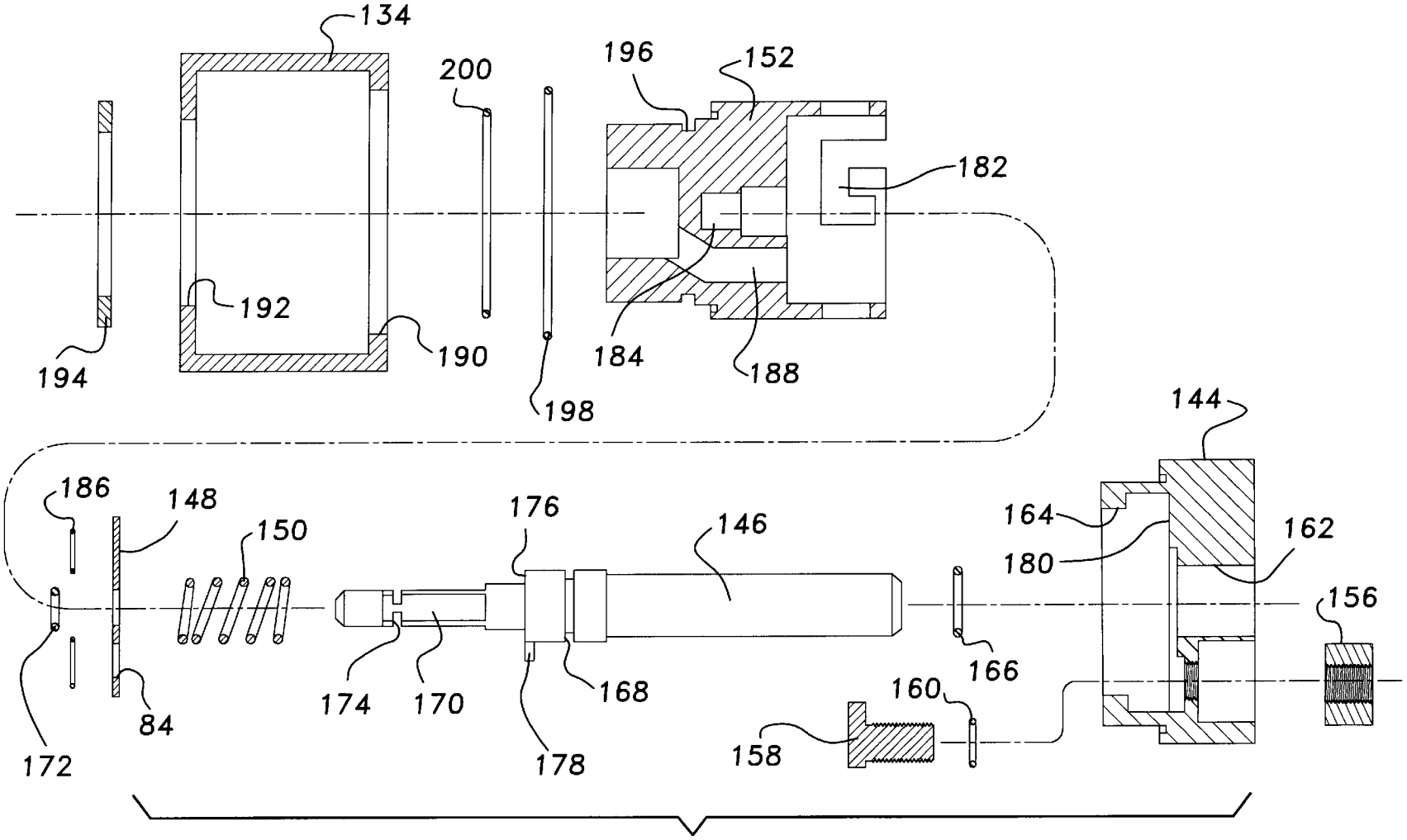
FIG. 7 is an exploded view partially in cross-section of the valve assembly shown in FIGS. 5 and 6.

FIGS. 5–7 illustrate a gas distribution system 120 in accordance with another embodiment of the present invention. Gas distribution system 120 comprises a single chambered manifold assembly 130, a plurality of gas lines or venturi tubes 132 and the plurality of gas burners 12. Manifold assembly 130, shown in section in FIG. 6, comprises a manifold 134 and a plurality of valve assemblies 136.

Manifold 134 is preferably manufactured from square or rectangular steel tubing to define a feed chamber 138 which extends the entire length of manifold 134. A pair of end caps 140 mate with manifold 134 to complete the isolation of feed chamber 138. A gas supply line 142 is shown extending through one end cap 140 to provide fuel to chamber 138. It is to be understood that supply line 142 could extend through either end cap 140 or through one of the walls of manifold 134 if desired for packaging or design considerations.

Each valve assembly 136 (four being shown in FIG. 5) comprises a front cover 144, a stem 146, a disc 148, a spring 150 and a back cover 152. Front cover 144 includes a low flame adjustment system 154 which is comprised of a cam lock 156, an adjusting cam 158 and a seal 160 which seals the interface between front cover 146 and adjustment system 154. Front cover 144 defines a bore 162 which extends through front cover 144 for receiving stem 146 and a plurality of tabs 164 which mate with back cover 152 to maintain the integrity of valve assembly 136.

Stem 146 is rotatably received within bore 162 for the regulation of gas flow through valve assembly 136. A seal 166 is located within an annular groove 168 to seal the interface between stem 146 and bore 162 of front cover 144. Stem 146 defines flatted surface 170 which mates with disc 148 such that stem 146 and disc 148 are rotatably coupled. While stem 146 is shown having a single flatted surface 170, it is within the scope of the present invention to provide a pair of flatted surfaces 170 if desired. Disc 148 is slidingly received on stem 146 and mates with flatted surface 170 to rotationally couple the two elements. A retaining ring 172 is received within a groove 174 on stem 146 to limit the travel of disc 148 and prohibit its removal. Spring 150 is disposed between disc 148 and a shoulder 176 on stem 146 to bias disc 148 towards retaining ring 172. A stop tab 178 extends from the outer surface of stem 146 to retain stem 146 within front cover 144. Stop tab 178 mates with low flame adjustment system 134 for the control of the low flame as is well known in the art.

Front cover 144 and stem 146 are both received by back cover 152. Back cover 152 defines a plurality of generally U-shaped slots 182 having an open end and a closed end to provide for a bayonet type assembly with front cover 144. Tabs 164 of front cover 144 are inserted into the open end of slot 182 and front cover 144 is then rotated with respect to back cover 152 to align tabs 164 with the closed end of slot 182. Back cover 152 defines a bore 184 which rotationally accepts stem 146. Thus, stem 146 is supported by bore 184 within back cover 152 and within bore 162 of front cover 144. This dual but separate and distinct support of stem 146 reduces wobble or stem displacement to an average of approximately 0.010 inches which is an improvement over the prior art industry average of approximately 0.020 inches. This reduction of stem wobble or displacement improves the feel and overall quality gas distribution system 120. An enlarged portion of bore 184 provides clearance for retaining ring 172. Disposed between disc 148 and back cover 152 are a plurality of elastomeric seals 186 for sealing the interface between disc element 148 and a gas port 188 extending through back cover 152. Elastomeric seals 186 are held in place by being located in recesses that are formed into back cover 152. Gas port 188 is adapted for mating with one of the plurality of gas lines 132 to direct gas flow to an individual sealed burner 12.

Valve assembly 136 is assembled to manifold assembly 130 by inserting back cover 152 through an aperture 190 in the front wall of manifold 134 and through an aperture 192 in the rear wall of manifold 134 aligned with aperture 190. A retaining ring 194 is disposed within an annular groove 196 in back cover 152 to secure valve assembly 136 to manifold 134. A front cover seal 198 seals the interface between the front wall of manifold 134 and front cover 144. A back cover seal 200 seals the interface between the back wall of manifold 134 and back cover 152. Thus, gas within feed chamber 138 of manifold 134 is directed through slots 182, through disc 148, through gas port 188 and through a respective gas line 132 to a respective sealed burner 12. The regulation of gas slow through disc 148 is identical to that detailed and shown above for valve disc 42. Disc 148 also defines through bore 84 and converging circular slot 86 for determining the rate of gas flow to the respective sealed burner 12.

While the above detailed description describes the preferred embodiment of the present invention, it should be understood that the present invention is susceptible to modification, variation and alteration without deviating from the scope and fair meaning of the subjoined claims.

What is claimed is:

1. A gas cooking appliance having a burner and a gas distribution system, said gas distribution system comprising:

a manifold mounted to said appliance, said manifold defining a gas input chamber;

first gas supply means for supplying gas to said gas input chamber;

second gas supplying means for supplying gas from said gas input chamber to said burner; and a valve assembly disposed within said gas input chamber, said valve assembly including a valve disc disposed within said gas input chamber and rotatably supported by said manifold, said valve disc regulating the flow of gas between said gas input chamber and said burner.

2. A gas cooking appliance having a plurality of burners and a gas distribution system, said gas distribution system comprising:

a manifold mounted longitudinally along one side of said appliance, said manifold defining a gas input chamber which extends substantially an entire length of said manifold;

first gas supply means for supplying gas to said gas input chamber;

second gas supplying means for supplying gas from said gas input chamber to each of said burners; and a plurality of valve assemblies disposed within said gas input chamber, each of said valve assemblies including a valve disc disposed within said gas input chamber and rotatable supported by said manifold, said valve disc regulating the flow of gas between said gas input chamber and a respective burner.

3. The gas cooking appliance according to claim 2 wherein, said second gas supplying means includes a gas line extending between each of said burners and said manifold.

4. The gas cooking appliance according to claim 2 wherein, said second gas supplying means includes a plurality of gas output chambers integral with said manifold, each of said plurality of gas output chambers extending substantially the length of said manifold.

5. The gas cooking appliance according to claim 2 wherein, said valve disc is rotatably secured to a valve stem, said valve stem being rotatably secured to said manifold such that a portion of said valve stem extends outside of said gas input chamber.

6. The gas cooking appliance according to claim 5 wherein, said valve stem is supported at two separate but distinct points to reduce stem wobble.

7. The gas cooking appliance according to claim 2, wherein said manifold functions as a valve body for each of said valve assemblies.

8. The gas cooking appliance according to claim 2 wherein, the regulation of the flow of gas between said gas input chamber and said respective burner occurs in a linear flow rate with respect to rotational position of said valve disc with respect to said manifold.

9. The manifold assembly according to claim 2 wherein, the regulation of the flow of gas between said gas input chamber and said respective gas output chamber occurs in a linear flow rate with respect to rotational position of said valve disc with respect to said body.

10. A gas cooking appliance having a plurality of burners and a gas distribution system, said gas distribution system comprising:

a manifold mounted to said appliance, said manifold defining a gas input chamber and a plurality of gas output chambers, each of said gas output chambers being in fluid communication with said gas input chamber;

gas supply means for supplying gas to said gas input chamber;

a gas line extending between each of said gas output chambers and a respective burner; and a plurality of valve assemblies disposed within said gas input chamber, each of said valve assemblies including a valve disc disposed within said gas input chamber and rotatably supported by said manifold, said valve disc regulating the flow of gas between said gas input chamber and a respective gas output chamber.

11. The gas cooking appliance according to claim 10 wherein, said manifold extends longitudinally along one side of said appliance, said gas input chamber extending over substantially the entire length of said manifold.

12. The gas cooking appliance according to claim 11 wherein, each of said gas output chambers extend over substantially the entire length of said manifold.

13. The gas cooking appliance according to claim 10 wherein, said valve disc is rotatably secured to a valve stem, said valve stem being rotatably secured to said manifold such that a portion of said valve stem extends outside of said gas input chamber.

14. The gas cooking appliance according to claim 13 wherein, said valve stem is supported at two separate but distinct points to reduce stem wobble.

15. The gas cooking appliance system according to claim 10, wherein said manifold functions as a valve body for each of said valve assemblies.

16. The gas cooking appliance according to claim 10 wherein, the regulation of the flow of gas between said gas input chamber and said respective burner occurs in a linear flow rate with respect to rotational position of said valve disc with respect to said manifold.

17. A manifold assembly for a gas distribution system, said manifold assembly comprising:

a longitudinally extending body, said body defining a gas input chamber and a plurality of gas output chambers, each of said gas output chambers being in fluid communication with said gas input chamber; and a plurality of valve assemblies disposed within said gas input chamber, each of said valve assemblies including a valve disc disposed within said gas input chamber and rotatable supported by said manifold, said valve disc regulating the flow of gas between said gas input chamber and a respective gas output chamber.

18. The manifold assembly according to claim 17 wherein, said valve disc is rotatably secured to a valve stem, said valve stem being rotatably secured to said manifold such that a portion of said valve stem extends outside of said gas input chamber.

19. The manifold assembly according to claim 18 wherein, said valve stem is supported at two separate but distinct points to reduce stem wobble.

20. The manifold assembly according to claim 17, wherein said longitudinally extending body functions as a valve body for each of said valve assemblies.

* * * * *

UNITED STATES PATENT AND TRADEMARK OFFICE

CERTIFICATE OF CORRECTION

PATENT NO. : 5,829,425

DATED : November 3, 1998

INVENTOR(S) : Garry Wayne Woods et al

It is certified that error appears in the above-indentified patent and that said Letters Patent is hereby corrected as shown below:

On the Title Page, [56], U.S. Patent Documents, reference 1,878,552, "3/1932" should be -- 9/1932 --.

Column 6, line 8, "slow" should be -- flow --.

Column 6, line 45, "rotatable" should be -- rotatably --.

Column 6, line 58, delete "rotatably".

Column 7, line 38, delete "rotatably".

Column 8, line 6, delete "system".

Column 8, line 24, "rotatable" should be -- rotatably --.

UNITED STATES PATENT AND TRADEMARK OFFICE

CERTIFICATE OF CORRECTION

PATENT NO. : 5,829,425

DATED : November 3, 1998

INVENTOR(S) : Garry Wayne Woods et al

It is certified that error appears in the above-identified patent and that said Letters Patent is hereby corrected as shown below:

Column 8, line 24, "manifold" should be -- body --.

Column 8, line 28, delete "rotatably".

Signed and Sealed this

Twenty-seventh Day of July, 1999

*Attest:*

Q. TODD DICKINSON

*Attesting Officer*

*Acting Commissioner of Patents and Trademarks*